US006681414B1

(12) United States Patent
May et al.

(10) Patent No.: US 6,681,414 B1
(45) Date of Patent: Jan. 27, 2004

(54) JET FLOW CONTROL FOR HYDROTHERAPY SPA

(75) Inventors: Tom M. May, Chattanooga, TN (US); George L. Hendricks, Chattanooga, TN (US); Scott A. Romano, Anaheim, CA (US)

(73) Assignee: May Manufacturing, Inc., Chattanooga, TN (US)

( * ) Notice: Subject to any disclaimer, the term of this patent is extended or adjusted under 35 U.S.C. 154(b) by 0 days.

(21) Appl. No.: 10/086,256

(22) Filed: Mar. 4, 2002

(51) Int. Cl.[7] ..... A47K 3/10
(52) U.S. Cl. ..... 4/541.1; 4/541.5; 4/541.6
(58) Field of Search ..... 4/541.1–541.6, 4/492; 239/428.5, 412; 601/160, 166

(56) References Cited

U.S. PATENT DOCUMENTS

| | | | | |
|---|---|---|---|---|
| 4,579,140 A | * | 4/1986 | Sekine | 137/202 |
| 4,785,484 A | * | 11/1988 | Sargent | 4/541.1 |
| 4,853,987 A | | 8/1989 | Jaworski | |
| 4,982,459 A | * | 1/1991 | Henkin et al. | 4/541.4 |
| 5,056,168 A | | 10/1991 | Mersmann | |
| 5,182,820 A | * | 2/1993 | Marks | 4/541.4 |
| 5,418,984 A | * | 5/1995 | Livingston, Jr. | 4/541.1 |
| 5,526,538 A | | 6/1996 | Rainwater | |
| 5,570,481 A | * | 11/1996 | Mathis et al. | 4/541.2 |
| 5,742,954 A | | 4/1998 | Idland | |
| 5,752,282 A | | 5/1998 | Silveri | |
| 5,898,958 A | | 5/1999 | Hall | |
| 5,983,416 A | * | 11/1999 | Idland | 4/541.1 |
| 6,000,073 A | * | 12/1999 | Eddington | 4/541.1 |
| 6,009,574 A | * | 1/2000 | Moreland | 4/541.5 |
| 6,405,387 B1 | * | 6/2002 | Barnes | 4/541.2 |

FOREIGN PATENT DOCUMENTS

| | | | |
|---|---|---|---|
| DE | 44 43 865 C2 | 1/1999 | F23Q/7/06 |
| DE | 100 04 507 A1 | 8/2001 | F24C/5/14 |

* cited by examiner

*Primary Examiner*—Henry Bennett
*Assistant Examiner*—Amanda Flynn
(74) *Attorney, Agent, or Firm*—Chambliss, Bahner & Stophel, P.C.

(57) ABSTRACT

A spa comprised of a fluid enclosure having a floor and an upstanding sidewall includes a plurality of therapy stations within the enclosure. Each therapy station includes a hydrotherapy assembly and each such assembly includes a plurality of fluid jets in the floor or sidewall of the enclosure and a fluid inlet through the floor or sidewall of the enclosure. Each hydrotherapy assembly also includes a fluid pump having a suction port that is in fluid communication with the inlet and a discharge port that is in fluid communication with the jets. The pump is adapted to move fluid from the enclosure through the fluid inlet and suction port and back through the discharge port and the jets into the enclosure. A variable flow controller is also provided for each hydrotherapy station, which controller is adapted to control the flow of fluid from the discharge port of the pump through the jets into the enclosure.

19 Claims, 4 Drawing Sheets

JET FLOW CONTROL FOR HYDROTHERAPY SPA

FIELD OF THE INVENTION

This invention relates generally to spas having a plurality of therapy stations each of which includes a plurality of hydrotherapy jets. More particularly, the invention relates to a water distribution and jet flow control system for such a spa.

BACKGROUND AND DESCRIPTION OF THE PRIOR ART

Bathing appliances in the nature of spas or hot tubs have become commercially successful. These spas are typically constructed as a molded shell to form a water containment or fluid enclosure having a footwell or floor and an upstanding sidewall. Molded within the enclosure are a plurality of therapy stations which may include seats or platforms for reclining. The shell is typically constructed of fiberglass, plastic or a similar material, or a composite of such materials. One or more pumps are usually placed under the shell to draw water from the enclosure and discharge it, usually with air, into the enclosure through a plurality of nozzles or jets of various types. The jets are usually mounted through the shell in either or both of the floor and sidewall. Typically, jets mounted through the sidewall are located below the water line of the spa, and in any event, the jets are designed to provide a comforting or therapeutic effect to a person occupying a therapy station. Water lines are provided between the various jets, pumps and water inlet ports, and are usually comprised of PVC piping and flexible tubing. Various filters, heaters, cleaning units and diverter valves may also be provided in the typical spa.

Conventional hot tubs or spas generally have three or four main therapy stations or seats, typically a lounge seat and a pair of corner seats, or four corner seats. They may also have one or more side stations or seats. All of these stations are usually provided with a number of jets through which warm water is forced to provide the hydrotherapy effects. These spas circulate and pump the water through the jets using one or two pumps, which are typically located on one, side of the spa for convenient access. Consequently, the system requires piping of significant length, diameter and complexity, and usually a number of diverter valves. Because of the significant lengths of piping between the pumps and the jets, significant frictional losses are encountered. In order to compensate for these frictional losses, conventional spas are usually provided with large pumps and motors. The typical spa of conventional design will have two 6 HP pumps, each of which has an output capacity at the pump of 230 gallons/minute. When one of these pumps of a conventional spa is operated, water is forced through jets at more than one station or seat, even if only one seat is occupied.

In recognition of some of these problems, spas have been developed that employ unitary hydrotherapy jet and pump assemblies, in which a pump is provided for each jet. Such assemblies are described in U.S. Pat. No. 4,853,987 of Jaworski, U.S. Pat. No. 5,056,168 of Mersmann and U.S. Pat. No. 5,742,954 of Idland. Such assemblies are limited to spas having only a few jets and would not be practical in a large spa having a plurality of jets at each of a plurality of therapy stations.

U.S. Pat. No. 6,000,073 of Eddington describes a system for adjusting the distribution of water flow between two supply pumps and the various therapy stations of a spa. A water supply line that is in fluid communication with all the jets is also connected to the pump outlets of the two pumps. Diverter valves are placed in the supply line on opposite sides of each therapy station or at other locations between the therapy stations. By setting one of the diverter valves to the "closed" position, the flow will be blocked between one therapy station and the adjacent one. This will serve to divide the jets between the two pumps, so that one or more therapy stations are supplied by one pump and the remainder by the other pump. In one embodiment of the Eddington device, a manifold is used to connect several jets in a therapy station to a water supply line, and diverter valves serve to divide the flow between the two pumps and the various jet manifolds. Although the Eddington system represents an improvement over the typical conventional system described above, it still requires piping of significant length, diameter and complexity, which leads to significant frictional losses. Such a system would still require large pumps and motors in order to compensate for these frictional losses.

It would be desirable if a spa could be provided that would provide the therapeutic effects of conventional spas through a number of jets at each therapy station without requiring the large pumps and motors of conventional systems. It would also be desirable if such a system could be provided that would include a separate control system for each therapy station.

ADVANTAGES OF THE INVENTION

An advantage of the invention is that by providing a motor for driving the hydrotherapy pump at each therapy station, less electricity is consumed than is consumed by a conventional spa having larger motors, each of which drives a pump for a plurality of therapy stations. Another advantage of the invention is that by employing a plurality of smaller motors than are used in a conventional spa, less motor noise is produced. Still another advantage of the invention is that by providing a pump for each therapy station, smaller and shorter fluid lines to the jets may be employed, thereby minimizing frictional losses.

An advantage of a preferred embodiment of the invention is that the variable flow controller which utilizes an air induction switch may be operated with a smaller pump and motor than in a conventional spa to obtain the effects of conventional jet flow. Another advantage of a preferred embodiment of the invention is that the variable flow controller which utilizes an air induction switch may provide a plurality of different flow control settings, all of which may be obtained by operation of a single-speed motor.

Additional objects and advantages of this invention will become apparent from an examination of the drawings and the ensuing description.

EXPLANATION OF TECHNICAL TERMS

As used herein, the term "jet" or "fluid jet" refers to an orifice or nozzle through which a fluid such as water may be pumped, discharged of dispensed into the fluid enclosure of a spa for therapeutic effect.

As used herein, the term "spa" or hot tub refers to a bathing appliance that is adapted to contain a fluid such as water and which includes a plurality of therapy stations that may be occupied by a person, each of which stations include one or more jets. Jets may be provided in various shapes and sizes to produce various therapeutic effects.

As used herein, the term "switchless motor" means a motor having a start winding and a running winding but not a mechanical mechanism or switch that takes the start winding out of the operating circuit when the motor reaches a certain speed.

SUMMARY OF THE INVENTION

The invention is a spa comprising a fluid enclosure having a floor and an upstanding sidewall, and a plurality of therapy stations within the enclosure. A hydrotherapy assembly is provided for each therapy station, with each such assembly including a plurality of fluid jets in the floor or sidewall of the enclosure and a fluid inlet through the floor or sidewall of the enclosure. Each hydrotherapy assembly also includes a fluid pump having a suction port that is in fluid communication with the inlet and a discharge port that is in fluid communication with the jets. The pump is adapted to move fluid from the enclosure through the fluid inlet and suction port and back through the discharge port and the jets into the enclosure. A variable flow controller is also provided for each hydrotherapy station, which controller is adapted to control the flow of fluid from the discharge port of the pump through the jets into the enclosure.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
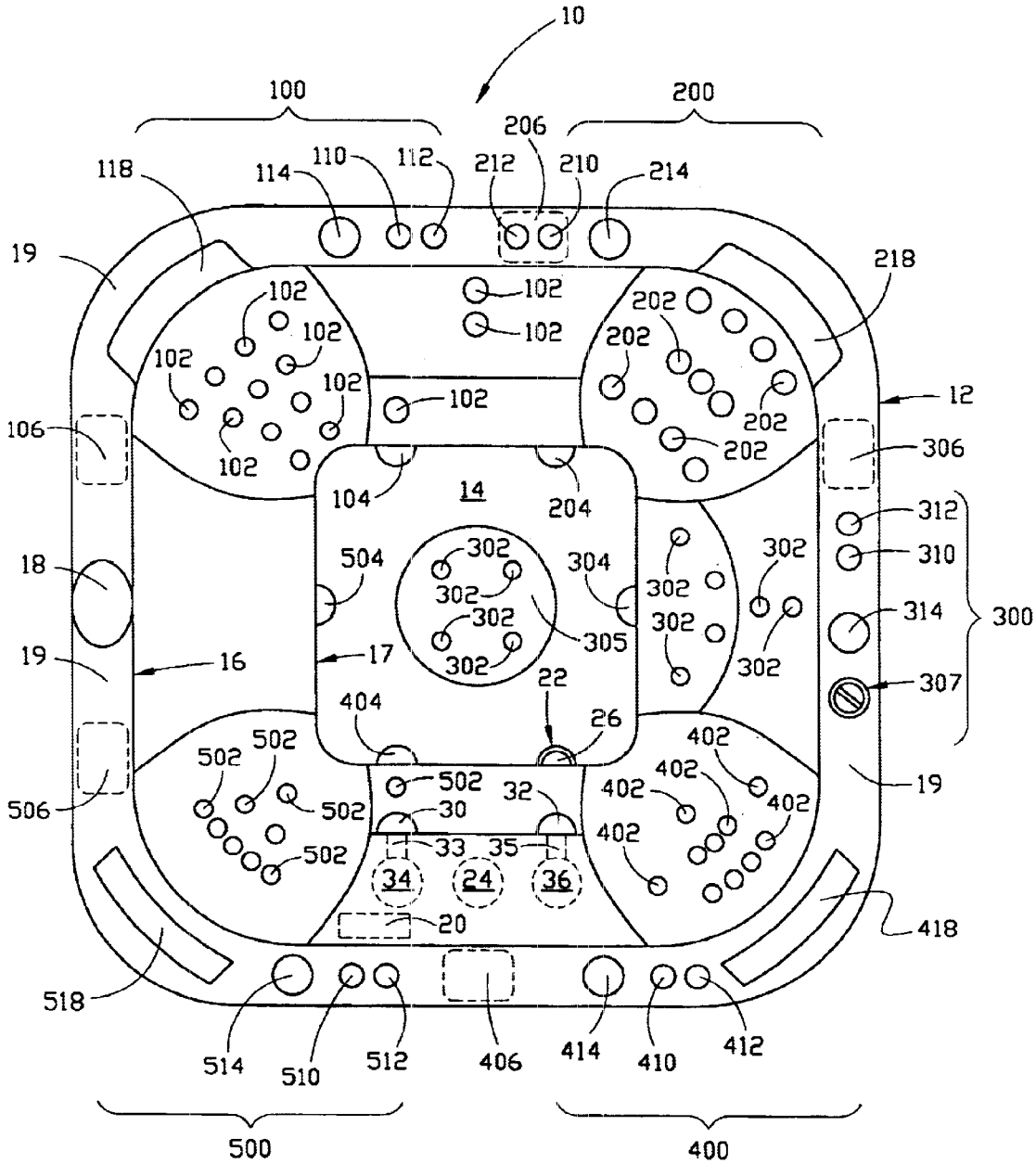
FIG. 1 is a top view of a preferred embodiment of the invention.

Referring now to the drawings, FIG. 1 illustrates referred spa 10, which comprises a fluid enclosure 12 having a floor 14 and an upstanding sidewall 16. The floor is located at the bottom of and is surrounded by upstanding footwell wall 17. The enclosure shell of preferred spa 10 is constructed of conventional materials. Spa 10 includes five therapy stations, designated generally as stations 100, 200, 300, 400 and 500, each of which includes a hydrotherapy assembly according to the invention.

Preferred main control panel 18 is mounted in upper surface 19, and includes controls for the power supply to all pumps, controls for water heaters (not shown), controls for lights (not shown), child safety controls and controls for circulating pump 20. Preferably, circulating pump 20 is a small pump (typically 1/32 HP) that circulates water from the enclosure through fluid inlet 22, through circulating filter 24, a heating and sanitation unit (not shown), and back to the enclosure through fluid return 26. Fluid return 26 is preferably located above fluid inlet 22 in footwell wall 17.

The hydrotherapy assembly associated with therapy station 100 includes a plurality of fluid jets 102 and at least one fluid inlet, such as unfiltered fluid inlet 104, which are mounted in and through the sidewall of the enclosure. The jets can be of any convenient size and type and can be arranged in various configurations. The fluid inlet can be of any convenient size and can be located in any convenient location. Fluid inlets may also be shared by more than one therapy station. Station 100 also includes a fluid pump 106 having a suction port and a discharge port (not shown in FIG. 1) and a variable flow controller that is adapted to control the flow of fluid from the discharge port of the pump through jets 102 into the enclosure. The preferred variable flow controller for therapy station 100 is comprised of air control inlet 110, an air control line (not shown in FIG. 1) that connects the air control inlet to the suction line of the pump, and means for adjusting the amount of air that is introduced into the suction port of the pump. The preferred assembly that is associated with therapy station 100 also includes On/Off switch 112 and external air inlet 114, both of which shall be described subsequently in more detail. Therapy station 100 also includes molded head rest 118.

Similarly, the hydrotherapy assembly associated with therapy station 200 includes fluid jets 202 and fluid inlet 204, which are mounted in and through the sidewall of the enclosure, fluid pump 206 and a variable flow controller including air control inlet 210, which shall be subsequently described in more detail. The assembly also includes On/Off switch 212 and external air inlet 214, also described subsequently. Therapy station 200 also includes head rest 218. Therapy station 300 includes fluid jets 302, some of which are mounted in and through the sidewall of the enclosure, and some of which are mounted in dome 305 of floor 14. Station 300 also includes fluid inlet 304, which is mounted in and through the sidewall of the enclosure, fluid pump 306 and a variable flow controller including air control inlet 310, which shall be subsequently described in more detail. The assembly also includes On/Off switch 312 and external air inlet 314, also described subsequently. Station 300 also includes diverter valve 307 which is used to divert water from pump 306 between the jets located in the sidewall of the enclosure and those located in dome 305. Therapy station 400 includes fluid jets 402 and fluid inlet 404, which are mounted in and through the sidewall of the enclosure, fluid pump 406 and a variable flow controller including air control inlet 410, which shall be subsequently described in more detail.

The assembly also includes On/Off switch 412 and external air inlet 414, also described subsequently. Therapy station 500 includes fluid jets 502 and fluid inlet 504, which are mounted in and through the sidewall of the enclosure, fluid pump 506 and a variable flow controller including air control inlet 510, which shall be subsequently described in more detail. The assembly also includes On/Off switch 512 and external air inlet 514, also described subsequently.

Each hydrotherapy assembly preferably includes a filtered fluid inlet through the floor or sidewall of the enclosure, and a plurality of hydrotherapy assemblies may share a single filtered fluid inlet. Thus, for example, filtered fluid inlet 30 may be included in the hydrotherapy assemblies associated with therapy stations 100 and 500, and filtered fluid inlet 32 may be included in the hydrotherapy assemblies associated with therapy stations 200, 300 and 400. Filtered fluid inlet 30 is connected by filter inlet line 33 to fluid filter 34 and filtered fluid inlet 32 is connected by filter inlet line 35 to fluid filter 36.

Figure 2:
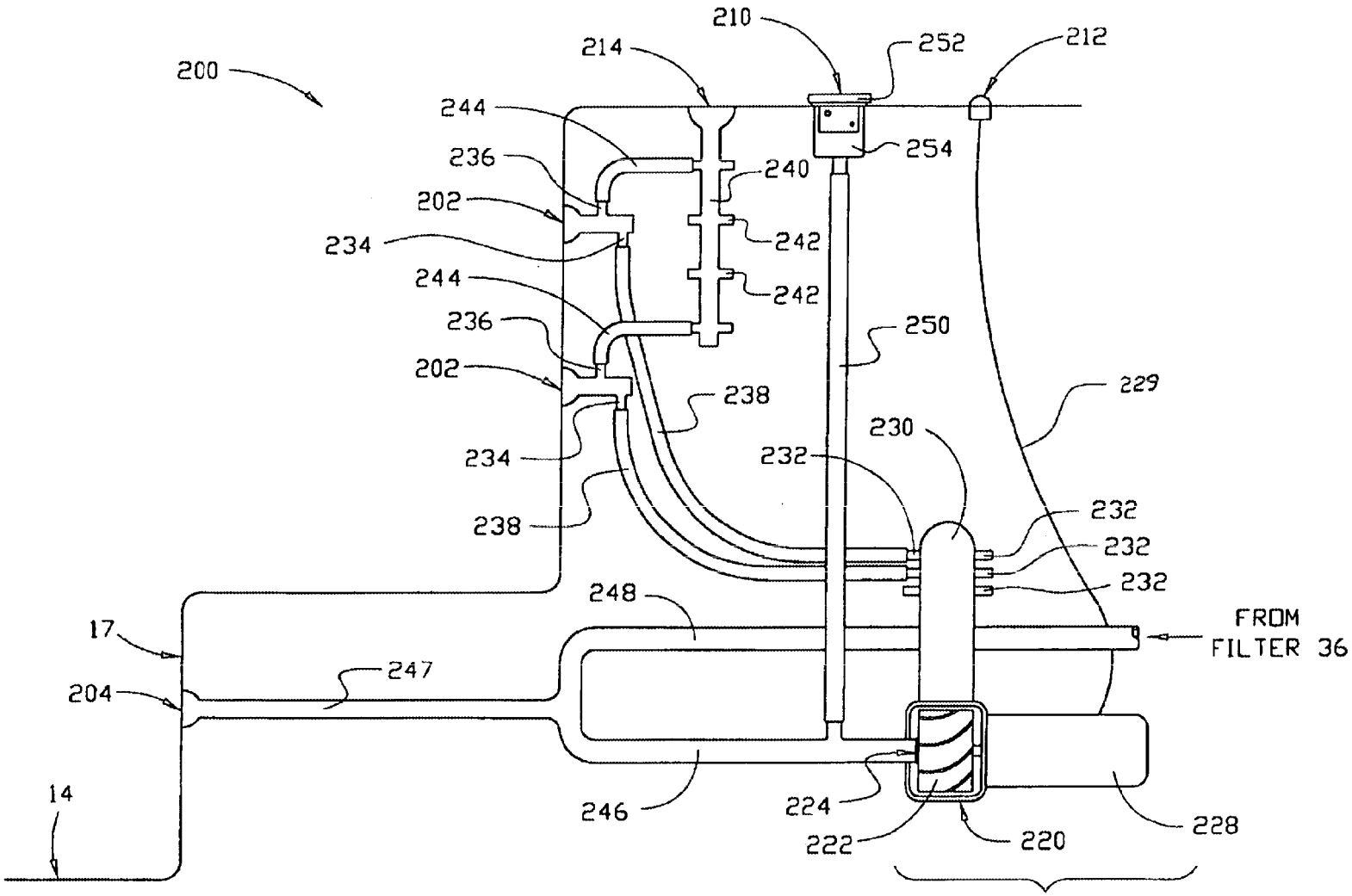
FIG. 2 is a partial cross-sectional view of a portion of the embodiment of FIG. 1 showing a first embodiment of a variable flow controller of the invention.

FIG. 2 illustrates additional details of a preferred hydrotherapy assembly by reference to a portion of therapy station 200. As shown in FIG. 2, the preferred hydrotherapy assembly includes a fluid pump 220 having an impeller 222, a suction port 224 that is in fluid communication with unfiltered fluid inlet 204 and a discharge port 226. The preferred assembly also includes motor 228 that is operatively connected to the pump to drive the impeller so that fluid may be pumped from the enclosure through unfiltered fluid inlet 204 to pump 220 and back through discharge port 226 of the pump. On/Off switch 212 (also shown in FIG. 1) is wired to motor 228 by wire 229 to turn the motor on and off (assuming that the main power switch in panel 18 is on). Preferably a discharge manifold such as manifold 230 is attached to the discharge port of the pump and provided with a number of manifold outlet ports 232 equal to the number of the jets in the assembly. Jet 202 (two of which are shown) includes a fluid portal 234 and an air portal 236, and a jet fluid line 238 is provided for each jet to connect the discharge manifold to the fluid portal of the jet. The preferred hydrotherapy assembly also includes an external air inlet such as air inlet 214 and an air manifold 240 that is attached to air inlet 214. The air manifold is provided with a number of outlet ports 242 equal to the number of jets in the assembly, and an air line 244 for each jet which connects the external air inlet with the air portal for the jet. The preferred assembly also includes a suction line, such as suction line 246, that is connected to the suction port 224 of pump 220, an unfiltered fluid line 247 that connects the unfiltered fluid inlet 204 to the suction line, and a filtered fluid line 248 that connects filter 36 (not shown in FIG. 2) to suction line 246. In operation, pump assembly 206 moves water from the spa enclosure by way of lines 247 and 248 to suction line 246 and into the suction port 224 of the pump. The water is then moved from the pump through discharge port 226 into discharge manifold 230, where it is distributed by outlet ports 232 and lines 238 to jets 202. At the same time, air from external air inlet 214 through air manifold 240 and air line 244 into air portal 236 of each jet 202 is entrained with the water passing through the jet by venturi effects due to the shape of the jet nozzle as water is discharged through the jet. Such venturi effects are well-known to those having ordinary skill in the art to which the invention relates.

The reason that suction line 246 is preferably connected to both unfiltered fluid inlet 204 and filtered fluid inlet 32 is to avoid damage to the system if filter 36 becomes clogged to the point that water is restricted from passing therethrough. In such event, the system can still draw water from the unfiltered inlet, thereby avoiding overheating of the motor and damaging the pump and motor.

Preferably, the motor utilized in connection with the invention is a switchless motor. Conventional motors typically utilize a two-winding design with one winding being for starting and the other for running at operating speed. Some type of switch is used to take the start winding out of the circuit once the motor reaches its operating speed or rate of rotation. The typical switch used is a mechanical device, sometimes known as a centrifugal switch, which employs springs and weights to open a set of electrical contacts to disconnect the start winding as the motor reaches its operating speed. The switchless motor also utilizes a pair of windings; however, the start winding is not disconnected from the circuit at any time. It stays in the circuit and assists the running winding in operating the motor. A capacitor may also be included in the circuit to increase the electrical efficiency of the motor. Since there is no need for a centrifugal switch or electrical contacts to switch out the start winding, the switchless motor can be shorter than the conventional motor. This permits the positioning of the motor bearings closer together than in conventional motors, thus enhancing the reliability of the motor. In addition, a switchless motor that is equipped with a capacitor will run quieter than a conventional motor because the capacitor will act as a buffer for electrical noise.

Switchless motors may be operated quite efficiently to drive a pump according to the invention. Thus, for example, a 1 HP motor-equipped pump may be operated according to the invention to discharge fluid through its discharge port at a rate of at least about 60 gallons per minute using no more than about 1000 watts of power. Similarly, a 1.5 HP motor-equipped pump may be operated according to the invention to discharge fluid through its discharge port at a rate of at least about 100 gallons per minute using no more than about 1500 watts of power.

Figure 5:
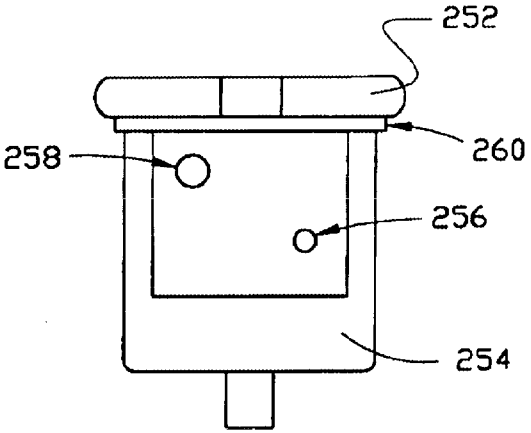
FIG. 5 is a side view of the air induction switch of FIG. 4.
Figure 7:
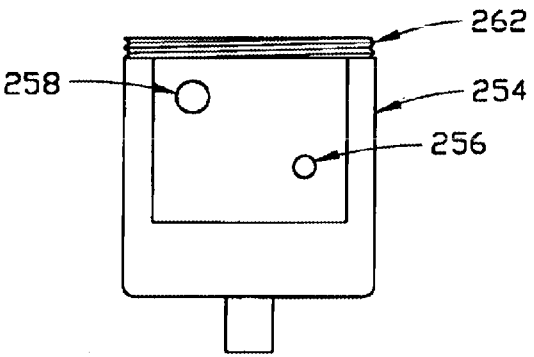
FIG. 7 is a side view of the air control inlet of the air induction switch of FIGS. 4 and 5.
Figure 4:
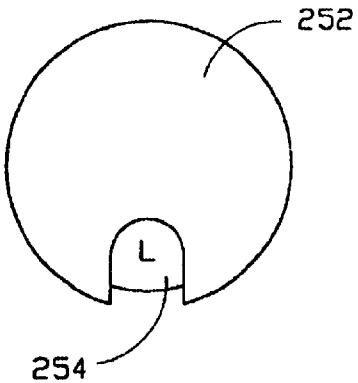
FIG. 4 is a top view of the air induction switch that forms a part of the variable flow controller of FIG. 2.

Referring again to FIG. 2, it is preferred that motor 228 be a switchless motor. Also, as shown in FIG. 2, the preferred variable flow controller for the hydrotherapy assembly is an air induction switch which permits introduction of air into the suction port of the pump. The air induction switch includes air control inlet 210, and air control line 250 which connects the air control inlet to the suction side of pump 220, either by connecting to suction line 246 (as shown in FIG. 2) or by connecting directly to the suction side of housing 221 of pump 220 (not shown). The air induction switch also includes means for adjusting the amount of air that is introduced into the suction port of the pump, the preferred embodiment of which is illustrated in more detail in FIGS. 4–8. As shown therein, a valve, such as valve 252 (see FIG. 5), is rotatably mounted in air control body 254 (see FIG. 7) of the air control inlet. The preferred air control body includes at least one hole that is in fluid communication with the air control line so as to admit external air into the air control line, although any convenient number of holes may be provided. As shown in FIGS. 5 and 7, air control body 254 includes a pair of such holes 256 and 258. Referring again to FIG. 2, as well as to FIGS. 4–8, it can be seen that air control inlet 210 comprised of air control body 254 and valve 252, is mounted through upper surface 19 of spa 10. Threaded retainer ring 260 is threaded onto the upper threaded portion 262 of the air control body to secure the body into place through upper surface 19. The holes in the air control body will be exposed to air beneath the upper surface of the spa. Valve 252 is open at its bottom 264 and has a window 266 in its side that permits air that passes through the window to pass through the valve and out the bottom. A pair of gaskets 268 and 270 serve to make an air tight seal with body 254 above and below the window. Valve 252 is adapted to block none, one or any number of holes in the air control inlet as the valve is rotated therein, so that the rate of flow of air through the air control line will vary depending on the number of holes in the air control inlet that are blocked by the valve. Thus, rotation of valve 252 within body 254 will expose no holes in the body to the window, either hole 256 or 258, or both holes 256 and 258. If valve 252 is positioned in body 254 so that no holes are exposed to the window, no air will be permitted to pass through the air control inlet into the air control line and into the suction port of the pump. If the valve is positioned so that only the smaller hole is exposed, some air will be permitted to pass through the air control inlet into the air control line and into the suction port of the pump. If the valve is positioned so that only the larger hole is exposed, an additional volume of air will be permitted to pass through the air control inlet. If the valve is positioned so that both holes are exposed, even more air will pass through the air control inlet. The upper surface of the air control body is preferably marked with indicators such as the "L" for "Low" that is illustrated in FIG. 4, corresponding to rotation of the valve to permit the passage of air through both holes.

As is known, the operation of a pump increases the pressure on the discharge side and decreases the pressure on the suction side. The preferred variable flow controller described above uses this phenomena to draw air into the suction side of the pump permitting "water slippage" inside the pump. As water and air are drawn into the suction port of the pump, the pressure on the discharge side decreases proportional to the amount of air being drawn into the suction port. The effect of the water that is discharged through the jets is markedly affected by this phenomena, creating the effect of a variable flow rate pump. However, the invention permits this variable flow rate effect to be accomplished with a single speed motor.

Preferred results may be obtained by a practice of the invention in which the diameter of the smallest hole in the air control inlet is at least about 8% of the diameter of the air control line. Preferably, as shown in the drawings, the air control inlet has a first hole and a second hole. If the air control line is provided with a diameter of within the range of about 0.35–0.40 inch, preferred results may be obtained with the first hole has a diameter within the range of about 0.025–0.045 inch and the second hole has a diameter within the range of about 0.035–0.060 inch. It has been found that if the air control line and hole sizes are within these ranges, operation of the invention with only the smallest hole in air control body 254 open will provide a 20–30% reduction in flow rate through the jets as compared with operation with all holes in the air control body blocked. Operation of the invention with both holes open will provide a 20–30% reduction in flow rate through the jets as compared with operation with only the smallest hole open. Most preferably, the air control line has a diameter of about 0.375 inch, the first hole has a diameter of about 0.031 inch and the second hole has a diameter of about 0.0426 inch.

It is also preferred that the fluid pump be operated so as to discharge fluid through its discharge port at a rate that it as least about 33% of the maximum unrestricted flow rating of the pump, while introducing air into the suction port of the pump. Thus, for example, a 1 HP switchless-motor equipped pump will have a maximum unrestricted flow rating of about. 100 gallons/minute. It is preferred that this pump be operated at a flow rate of at least about 33 gallons/minute.

Figure 3:
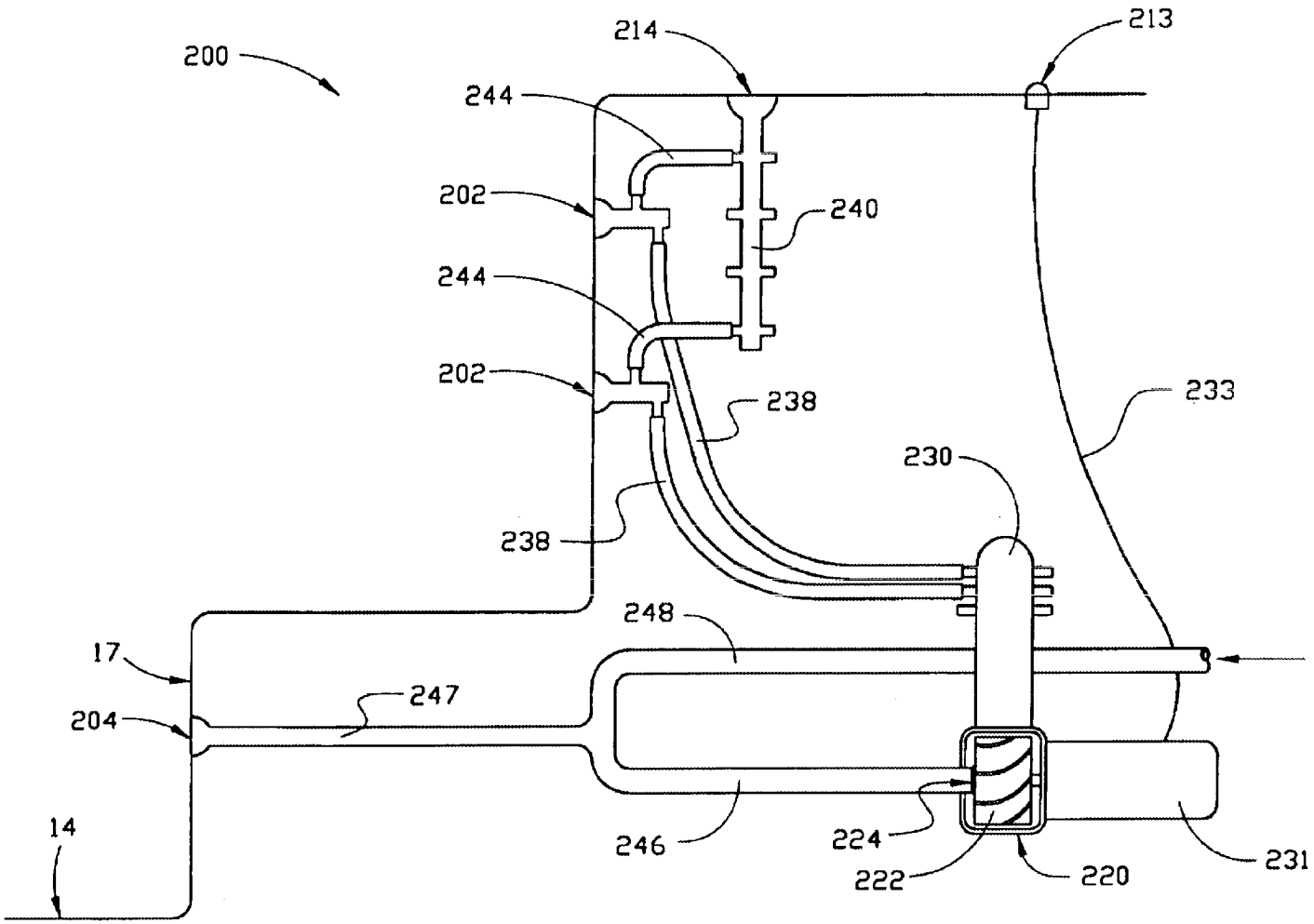
FIG. 3 is a partial cross-sectional view of a portion of an alternate embodiment to the spa of FIG. 1 showing a second embodiment of a variable flow controller of the invention.
Figure 6:
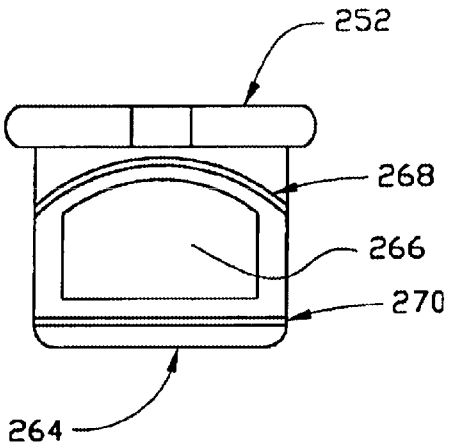
FIG. 6 is a side view of the valve of the air induction switch of FIGS. 4 and 5.
Figure 8:
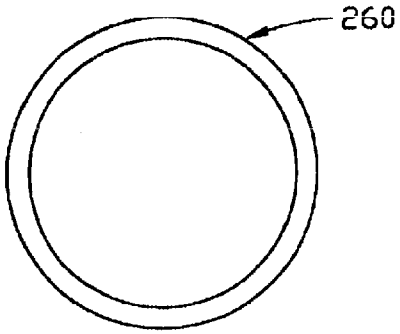
FIG. 8 is a top view of the retainer of the air control inlet of the air induction switch of FIGS. 4 and 5.

Another embodiment of the variable flow controller of the invention is illustrated in FIG. 3. As shown therein, the hydrotherapy assembly includes a fluid pump 220 having an impeller 222, a suction port 224 that is in fluid communication with unfiltered fluid inlet 204 and a discharge port 226. This assembly also includes motor 231 that is operatively connected to the pump to drive the impeller so that fluid may be pumped from the enclosure through unfiltered fluid inlet 204 to pump 220 and back through discharge port 226 of the pump. Preferably a discharge manifold such as manifold 230 is attached to the discharge port of the pump and a jet fluid line 238 is provided for each jet to connect the discharge manifold to the fluid portal of the jet. The preferred hydrotherapy assembly also includes an external air inlet such as air inlet 214 and an air manifold 240 that is attached to air inlet 214. The air manifold is provided with an air line 244 for each jet which connects the external air inlet with the air portal for the jet. The preferred assembly also includes a suction line, such as suction line 246, that is connected to the suction port 224 of pump 220, an unfiltered fluid line 247 that connects the unfiltered fluid inlet 204 to the suction line, and a filtered fluid line 248 that connects filter 36 (not shown in FIG. 3) to suction line 246. In this embodiment of the invention, rheostat-type On/Off switch 213 is wired to motor 231 by wire 233 to turn the motor on and off (assuming that the main power switch in panel 18 is on) and to vary the speed of the motor, thereby providing variable flow control for the pump.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A spa comprising:

(a) a fluid enclosure having a floor and an upstanding sidewall;

(b) a plurality of therapy stations within the enclosure;

(c) a hydrotherapy assembly for each therapy station, said assembly comprising:

(i) a plurality of fluid jets in the floor or sidewall of the enclosure;

(ii) a fluid inlet through the floor or sidewall of the enclosure;

(iii) a fluid pump having a suction port that is in fluid communication with the inlet and a discharge port that is in fluid communication with the jets, which pump is adapted to move fluid from the enclosure through the fluid inlet and suction port and back through the discharge port and the jets into the enclosure;

(iv) a variable flow controller that is adapted to vary the rate of flow of fluid from the discharge port of the pump through the jets into the enclosure by adjusting the amount of air that is introduced into the suction port of the pump.

2. The spa of claim 1 wherein each hydrotherapy assembly includes:

(a) a plurality of fluid jets in the floor or sidewall of the enclosure;

(b) a filtered fluid inlet through the floor or sidewall of the enclosure;

(c) a fluid filter;

(d) a filter inlet line that connects the filtered fluid inlet to the filter;

(e) an unfiltered fluid inlet through the floor or sidewall of the enclosure;

(f) a fluid pump having a suction port and a discharge port that is in fluid communication with the jets;

(g) a suction line that is connected to the suction port of the pump;

(h) a filtered fluid line that connects the fluid filter to the suction line;

(i) an unfiltered fluid line that connects the unfiltered fluid inlet to the suction line.

3. The spa of claim 1 wherein each hydrotherapy assembly includes:

(a) a fluid pump having an impeller, a suction port that is in fluid communication with the fluid inlet and a discharge port;

(b) a motor operatively connected to the pump to drive the impeller so that fluid may be pumped from the enclosure through the fluid inlet to the pump and back through the discharge port of the pump.

4. The spa of claim 3 wherein each hydrotherapy assembly includes:

(a) a plurality of fluid jets in the floor or sidewall of the enclosure, each of which includes a fluid portal and an air portal;

(b) a discharge manifold that is attached to the discharge port;

(c) a jet fluid line for each jet that connects the discharge manifold to the fluid portal of the jet;

(d) an external air inlet;

(e) an air line for each jet which connects the external air inlet with the air portal for the jet;

(f) a variable flow controller that is adapted to control the flow of fluid through the discharge port of the pump and through the discharge manifold to each jet.

5. The spa of claim 3 wherein the motor for each hydrotherapy assembly is a switchless motor.

6. A spa comprising:

(a) a fluid enclosure having a floor and an upstanding sidewall;

(b) a plurality of therapy stations within the enclosure;

(c) a hydrotherapy assembly for each therapy station, said assembly comprising:

(i) a plurality of fluid jets in the floor or sidewall of the enclosure;

(ii) a fluid inlet through the floor or sidewall of the enclosure;

(iii) a fluid pump having:

(a) a suction port that is located on a suction side of the pump, which suction port is in fluid communication with the inlet, and (b) a discharge port that is in fluid communication with the jets; which pump is adapted to move fluid from the enclosure through the fluid inlet and suction port and back through the discharge port and the jets into the enclosure;

(iv) an air induction switch comprising:

(a) an air control inlet;

(b) an air control line that connects the air control inlet to the suction side of the pump;

(c) means for adjusting the amount of air that is introduced into the suction port of the pump.

7. The spa of claim 6:

(a) wherein the air control inlet has a hole therein which is in fluid communication with the air control line;

(b) which includes a valve for the air control inlet that is rotatably mounted therein, said valve being adapted to block or to open the hole in the air control inlet as the valve is rotated therein, so that the rate of flow of air through the air control line will vary depending on whether the hole in the air control inlet is blocked by the valve.

8. The spa of claim 7 wherein the diameter of the hole in the air control inlet is at least about 8% of the diameter of the air control line.

9. The spa of claim 7 wherein the hole is located in the side of the air control inlet.

10. The spa of claim 6:

(a) wherein the air control inlet has a plurality of holes therein, which holes are in fluid communication with the air control line;

(b) which includes a valve for the air control inlet that is rotatably mounted therein, said valve being adapted to block none, one or any number of holes in the air control inlet as the valve is rotated therein, so that the rate of flow of air through the air control line will vary depending on the number of holes in the air control inlet that are blocked by the valve.

11. The spa of claim 10 wherein the diameter of the smallest hole in the air control inlet is at least about 8% of the diameter of the air control line.

12. The spa of claim 10 wherein the air control inlet has a first hole and a second hole, and wherein the air control line has a diameter of within the range of about 0.35–0.40 inch, the first hole has a diameter within the range of about 0.025–0.045 inch and the second hole has a diameter within the range of about 0.035–0.060 inch.

13. The spa of claim 10 wherein the air control inlet has a first hole and a second hole, and wherein the air control line has a diameter of about 0.375 inch, the first hole has a diameter of about 0.031 inch and the second hole has a diameter of about 0.0426 inch.

14. A spa comprising:

(a) a fluid enclosure having a floor and an upstanding sidewall;

(b) a plurality of therapy stations within the enclosure;

(c) a hydrotherapy assembly for each therapy station, said assembly comprising:

(i) a plurality of fluid jets in the floor or sidewall of the enclosure, each of which includes a fluid portal and an air portal;

(ii) a fluid pump having an impeller, a suction port and a discharge port;

(iii) a switchless motor operatively connected to the pump to drive the impeller;

(iv) a filtered fluid inlet through the floor or sidewall of the enclosure;

(v) a fluid filter;

(vi) a filter inlet line that connects the filtered fluid inlet to the filter;

(vii) an unfiltered fluid inlet through the floor or sidewall of the enclosure;

(viii) a suction line that is connected to the suction port of the pump;

(ix) a filtered fluid line that connects the fluid filter to the suction line;

(x) an unfiltered fluid line that connects the unfiltered fluid inlet to the suction line;

(xi) a discharge manifold that is attached to the discharge port, which discharge manifold has a fluid port for each jet;

(xii) a jet fluid line for each jet that connects the discharge manifold to the fluid portal for the jet;

(xiii) an external air inlet;

(xiv) an air manifold that is attached to the external air inlet, which manifold has an air port for each jet;

(xv) an air line for each jet that connects the air port of the air manifold to the air portal of the jet;

(xvi) an air control inlet;

(xvii) an air control line that connects the air control inlet to the suction line;

(xviii) means for adjusting the amount of air that is introduced into the suction port of the pump.

15. The spa of claim 14:

(a) wherein the air control inlet has a hole therein which is in fluid communication with the air control line;

(b) which includes a valve for the air control inlet that is rotatably mounted therein, said valve being adapted to block or to open the hole in the air control inlet as the valve is rotated therein, so that the rate of flow of air through the air control line will vary depending on whether the hole in the air control inlet is blocked by the valve.

16. The spa of claim 14:

(a) wherein the air control inlet has a pair of holes therein, which holes are in fluid communication with the air control line;

(b) which includes a valve for the air control inlet that is rotatably mounted therein, said valve being adapted to block none, one or both of the holes in the air control inlet as the valve is rotated therein, so that the rate of flow of air through the air control line will vary depending on the number of holes in the air control inlet that are blocked by the valve.

17. A method for operating a spa, which spa comprises:

(a) a fluid enclosure having a floor and an upstanding sidewall;

(b) a plurality of therapy stations within the enclosure wherein each therapy station comprises:

(c) at least one fluid jet in the sidewall of the enclosure;

(d) a fluid inlet through the floor or the sidewall of the enclosure;

(e) a fluid pump having a suction port that is in fluid communication with the fluid inlet and a discharge port that is in fluid communication with the jet, said pump being adapted to move fluid from the enclosure through the fluid inlet to the pump and back through the jet into the enclosure;

(f) a suction line that connects the fluid inlet of the spa with the suction port of the pump;

(g) an air control inlet that is in fluid communication with the suction line;

which method comprises operating the fluid pump so as to discharge fluid through its discharge port at a rate that it as least about 33% of the maximum unrestricted flow rating of the pump, while introducing air into the suction port of the pump.

18. The method of claim 17 which includes operating the fluid pump so as to discharge fluid through its discharge port at a rate of at least about 60 gallons per minute using no more than about 1000 watts of power.

19. The method of claim 17 which includes operating the fluid pump so as to discharge fluid through its discharge port at a rate of at least about 100 gallons per minute using no more than about 1500 watts of power.

* * * * *